US010047917B2

(12) United States Patent
Li et al.

(10) Patent No.: US 10,047,917 B2
(45) Date of Patent: Aug. 14, 2018

(54) LIGHT-EMITTING MODULE

(71) Applicant: PlayNitride Inc., Tainan (TW)

(72) Inventors: Yun-Li Li, Tainan (TW); Gwo-Jiun Sheu, Tainan (TW); Kuan-Yung Liao, Tainan (TW); Po-Jen Su, Tainan (TW); Jun-Yu Lin, Tainan (TW); Sheng-Yuan Sun, Tainan (TW)

(73) Assignee: PlayNitride Inc., Tainan (TW)

( * ) Notice: Subject to any disclaimer, the term of this patent is extended or adjusted under 35 U.S.C. 154(b) by 124 days.

(21) Appl. No.: 14/820,574

(22) Filed: Aug. 7, 2015

(65) Prior Publication Data

US 2016/0053950 A1 Feb. 25, 2016

(30) Foreign Application Priority Data

Aug. 21, 2014 (TW) ..... 103128784 A

(51) Int. Cl.

| | |
|---|---|
| ***F21K 9/64*** | (2016.01) |
| ***F21K 99/00*** | (2016.01) |
| *F21V 9/30* | (2018.01) |
| *F21V 29/70* | (2015.01) |
| *F21Y 101/00* | (2016.01) |
| *F21Y 115/30* | (2016.01) |
| *F21Y 115/10* | (2016.01) |

(52) U.S. Cl.

CPC ..... *F21K 9/56* (2013.01); *F21K 9/64* (2016.08); *F21V 29/70* (2015.01); *F21Y 2101/00* (2013.01); *F21Y 2115/10* (2016.08); *F21Y 2115/30* (2016.08)

(58) Field of Classification Search

CPC .. F21K 9/56; F21K 9/64; G02B 27/10; G02B 27/106; G02B 27/145; F21V 7/0016

See application file for complete search history.

(56) References Cited

U.S. PATENT DOCUMENTS

| | | | | |
|---|---|---|---|---|
| 4,690,490 | A * | 9/1987 | Mori | F21S 11/00 385/147 |
| 2008/0111145 | A1* | 5/2008 | Lin | H01L 33/507 257/98 |
| 2008/0123339 | A1* | 5/2008 | Bierhuizen | H01L 33/644 362/293 |

(Continued)

FOREIGN PATENT DOCUMENTS

| | | |
|---|---|---|
| TW | 201127936 | 8/2011 |
| TW | 201135984 | 10/2011 |

OTHER PUBLICATIONS

"Office Action of Taiwan Counterpart Application", dated May 9, 2016, p. 1-p. 5.

*Primary Examiner* — Anh Mai
*Assistant Examiner* — Nathaniel Lee
(74) *Attorney, Agent, or Firm* — JCIPRNET

(57) ABSTRACT

A light-emitting module including a light emitting component, a heat dissipation element, and a light-converting component is provided. The light-emitting component is adapted to emit a light beam. The heat dissipation element is disposed at one side of the light-emitting component, wherein the heat dissipation element has a light through hole and the light through hole is located at a transmission path of the light beam. The light-converting component is connected to the heat dissipation element and covers the light through hole.

12 Claims, 4 Drawing Sheets

(56) References Cited

U.S. PATENT DOCUMENTS

2011/0215701 A1* 9/2011 Tong ..... F21K 9/00
313/46
2015/0340547 A1* 11/2015 Tamaki ..... H01L 33/504
438/29

* cited by examiner

LIGHT-EMITTING MODULE

CROSS-REFERENCE TO RELATED APPLICATION

This application claims the priority benefit of Taiwan application Ser. No. 103128784, filed on Aug. 21, 2014. The entirety of the above-mentioned patent application is hereby incorporated by reference herein and made a part of this specification.

BACKGROUND

Technical Field

The invention relates to a light-emitting module. Particularly, the invention relates to a light-emitting module having a heat dissipation element and a light-converting component.

Related Art

Along with the rising awareness of global environmental protection, energy-saving electronic products have become today's development trend. Taking the lighting industry as an example, since light-emitting diodes (LEDs) and laser diodes (LDs) have advantages of energy-saving, low power consumption, high efficiency, fast response time, long service life and mercury free, etc., the LEDs and LDs gradually occupy a place in the market.

In order to achieve different light-emitting colors, a commonly used method is to dispose phosphor powder above a light-emitting component. When a light emitted by the light-emitting component irradiates the phosphor powder, a white light conversion is started. However, during the light conversion process when the phosphor powder is excited, the generated heat is accumulated on the phosphor powder, which may cause continuous increase of a temperature of the phosphor powder. If the heat cannot be effectively dissipated and is accumulated in the phosphor powder, conversion efficiency of the phosphor powder and light-emitting efficiency of the light-emitting component are decreased.

SUMMARY

The invention is directed to a light-emitting module, which has a better heat dissipation characteristic and better light-emitting efficiency.

The invention provides a light-emitting module includes a light-emitting component, a heat dissipation element, and a light-converting component. The light-emitting component is adapted to emit a light beam. The heat dissipation element is disposed at one side of the light-emitting component, wherein the heat dissipation element has a light through hole, and the light through hole is located at a transmission path of the light beam. The light-converting component is connected to the heat dissipation element, and covers the light through hole.

In an embodiment of the invention, the heat dissipation element has an accommodating groove. The light-converting component is connected to the heat dissipation element through the accommodating groove.

In an embodiment of the invention, the accommodating groove is located on a surface of the heat dissipation element.

In an embodiment of the invention, the accommodating groove is located in the light through hole.

In an embodiment of the invention, the light-converting component includes a first light-converting layer and a second light-converting layer. The first light-converting layer is located between the heat dissipation element and the second light-converting layer.

In an embodiment of the invention, the first light-converting layer is connected to the heat dissipation element.

In an embodiment of the invention, the first light-converting layer and the second light-converting layer are all connected to the heat dissipation element.

In an embodiment of the invention, heat transfer coefficient of the first light-converting layer is higher than heat transfer coefficient of the second light-converting layer.

In an embodiment of the invention, a material of the first light-converting layer and the second light-converting layer are respectively selected from single crystal phosphor, polycrystalline phosphor, glass phosphor and fluorescent gel.

In an embodiment of the invention, materials of the first light-converting layer and the second light-converting layer are different.

According to the above description, based on a connection relationship between the light-converting component and the heat dissipation element, the light-emitting module of the invention transfers the heat generated by the light-converting component to the heat dissipation element, where the heat is generated when the light-converting component receives the light generated by the light-emitting component to perform light conversion, and the heat is dissipated through thermal exchange between the heat dissipation element and external air. In this way, the heat is not accumulated on the light-converting component, such that the light-converting component has higher light-converting efficiency, and the light-emitting module has higher light-emitting efficiency.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
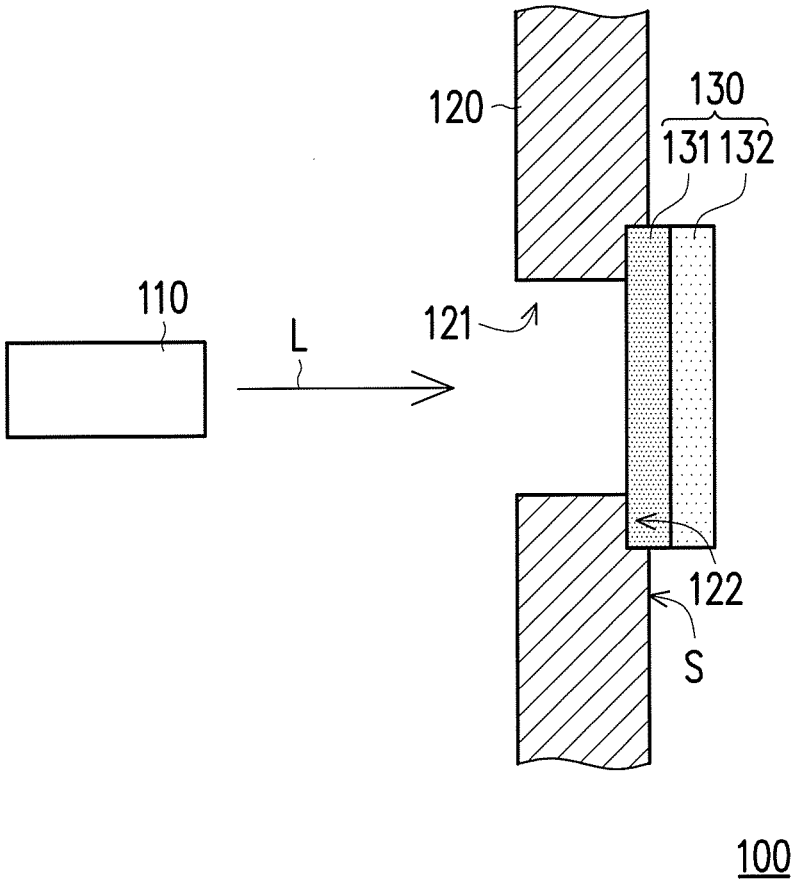
FIG. 1A is a schematic diagram of a light-emitting module according to an embodiment of the invention.

FIG. 1A is a schematic diagram of a light-emitting module according to an embodiment of the invention. Referring to FIG. 1A, in the present embodiment, the light-emitting module 100 includes a light-emitting component 110, a heat dissipation element 120 and a light-converting component 130. The light-emitting component 110 is, for example, a light-emitting diode (LED) or a laser diode that is adapted to emit a light beam, which is not limited by the invention.

In the present embodiment, the light-emitting component 110 can be disposed on a substrate (not shown), for example, an aluminium substrate, a copper substrate, a ceramic substrate, a fibreglass substrate or a printed circuit board (PCB) for electrically connecting an external circuit (not shown). The heat dissipation element 120 is disposed at one side of the light-emitting component 110, where the heat dissipation element 120 has a light through hole 121, and the light through hole 121 is located at a transmission path of a light beam L emitted by the light-emitting component 110. The heat dissipation element 120 can be made of metal, ceramic or other materials with higher thermal conductivity, which is preferably, aluminium or copper, though the invention is not limited thereto. On the other hand, the light-converting component 130 is connected to the heat dissipation element 120, and covers the light through hole 121. Namely, the light-converting component 130 is also located at the transmission path of the light beam L, so that after the light beam L passes through the light through hole 121, the light beam L can irradiate the light-converting component 130, and the light-converting component 130 can convert the light beam L into different color light for emitting out of the light-emitting module 100.

In the embodiment of the invention, the light-converting component 130 can be fixed on the heat dissipation element 120 by means of buckling, locking or adhering, etc., which is not limited by the invention. The heat dissipation element 120 further has an accommodating groove 122, and the light-converting component 130 is connected to the heat dissipation element 120 through the accommodating groove 122. The accommodating groove 122 can be located on a surface S of the heat dissipation element 120, and is communicated with the light through hole 121.

To be specific, the light-converting element 130 may include a first light-converting layer 131 and a second light-converting layer 132. In the present embodiment, the light-converting element 130 is, for example, connected to the heat dissipation element 120 through the first light-converting layer 131, and the second light-converting layer 132 does not contact the heat dissipation element 120, such that the light beam L passing through the second light-converting layer 132 has a larger light-emitting area. The first light-converting layer 131 is connected to the accommodating groove 122 of the heat dissipation element 120, where a depth of the accommodating groove 122 is substantially smaller than a thickness of the first light-converting layer 131, by which not only heat dissipation efficiency is considered, but also a larger light-emitting area is achieved. Particularly, heat transfer coefficient of the first light-converting layer 131 is higher than heat transfer coefficient of the second light-converting layer 132. Therefore, when the first light-converting layer 131 and the second light-converting layer 132 sequentially receive the light beam L emitted by the light-emitting component 110 to perform light conversion, the heat generated by the first light-converting layer 131 can be quickly transferred to the heat dissipation element 120, and besides that the second light-converting layer 132 is not influenced by the heat generated by the first light-converting layer 131, the heat generated by the second light-converting layer 132 can be transferred to the heat dissipation element 120 through the first light-converting layer 131. Finally, the aforementioned heat can be dissipated through thermal exchange between the heat dissipation element 120 and external air. In this way, the heat is not accumulated on the light-converting component 130, such that the light-converting component 130 may have better light conversion efficiency, so as to mitigate a color shift phenomenon, and the light-emitting module 100 may have better light-emitting efficiency. Moreover, a material of the first light-converting layer 131 and the second light-converting layer 132 are respectively selected from single crystal phosphor, polycrystalline phosphor, glass phosphor and fluorescent gel, though the invention is not limited thereto. Preferably, the materials of the first light-converting layer 131 and the second light-converting layer 132 are different, for example, the first light-converting layer 131 is made of the single crystal phosphor with high heat transfer coefficient, and the second light-converting layer 132 is made of the polycrystalline phosphor with secondary high heat transfer coefficient. Alternatively, the first light-converting layer 131 is made of the single crystal phosphor with high heat transfer coefficient, and the second light-converting layer 132 is made of the fluorescent gel with a fluorescent powder occupying a percentage concentration by weight of more than 70% and having higher thermal endurance, though the invention is not limited thereto. Moreover, the first light-converting layer 131 and the second light-converting layer 132 can be phosphors with different colors, for example, the first light-converting layer 131 and the second light-converting layer 132 are respectively a red phosphor and a yellow phosphor, and have a better color rendering index. Preferably, a light-converting wavelength of the first light-converting layer 131 and the second light-converting layer 132 is progressively decreased along a direction away from the light-emitting component 110, such that the longer wavelength converted first is not absorbed by the shorter wavelength converted later.

Figure 1B:
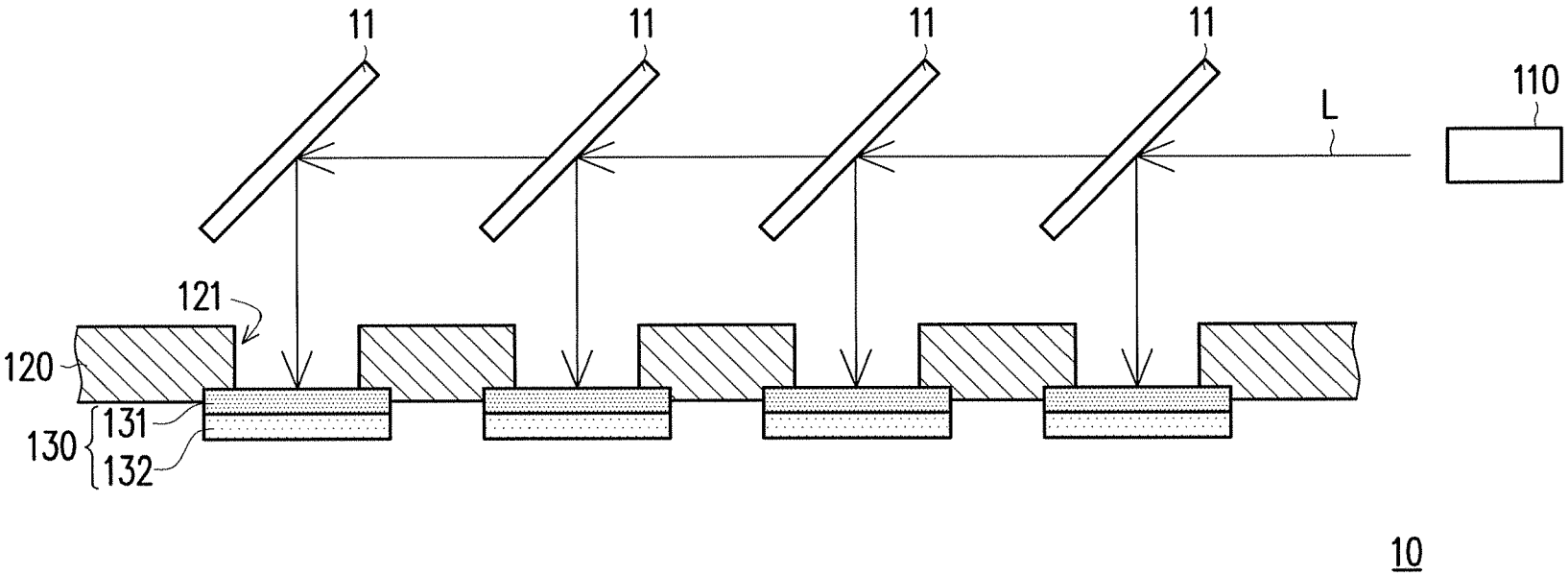
FIG. 1B is a schematic diagram of a light-emitting device adopting the light-emitting module of FIG. 1A.

FIG. 1B is a schematic diagram of a light-emitting device adopting the light-emitting module of FIG. 1A. Referring to FIG. 1A and FIG. 1B, the light-emitting device 10 is, for example, a band-shaped light-emitting device or a planar light-emitting device, which may include one or a plurality of light-emitting components 110. In the present embodiment, one light-emitting device 110 is taken as an example for description, though the invention is not limited thereto. To be specific, in order to achieve a band-shaped light-emitting effect or a planar light-emitting effect, in the light-emitting device 10, a plurality of light-converting components 130 is connected to the heat dissipation element 120 having a plurality of light through holes 121, where each of the light-converting elements 130 covers the corresponding light through hole 121. On the other hand, the light-emitting device 10 further includes a plurality of beam splitters 11, and each of the beam splitters 11 is disposed above the corresponding light-converting component 130, and is located on the transmission path of the light beam L emitted by the light-emitting component 110, such that the light beam L can irradiate the corresponding light-converting component 130 through the beam splitter 11, so as to implement light conversion.

Since the light-emitting device 10 adopts a design concept the same with that of the light-emitting module 100, the heat generated by the light-converting components 130 as the light-converting components receive the light beam L emitted by the light-emitting component 110 to perform light conversion can be transferred to the heat dissipation element 120, and the heat can be dissipated through the thermal exchange between the heat dissipation element 120 and the external air. In this way, the aforementioned heat is not accumulated on the light-converting component 130, such that the light-converting component 130 may have better light conversion efficiency, so as to mitigate a color shift phenomenon, and the light-emitting module 100 may have better light-emitting efficiency.

Other embodiments are provided below for further description. It should be noted that reference numbers of the components and a part of contents of the aforementioned embodiment are also used in the following embodiment, wherein the same reference numbers denote the same or like components, and descriptions of the same technical contents are omitted. The aforementioned embodiment can be referred for descriptions of the omitted parts, and detailed descriptions thereof are not repeated in the following embodiments.

Figure 2:
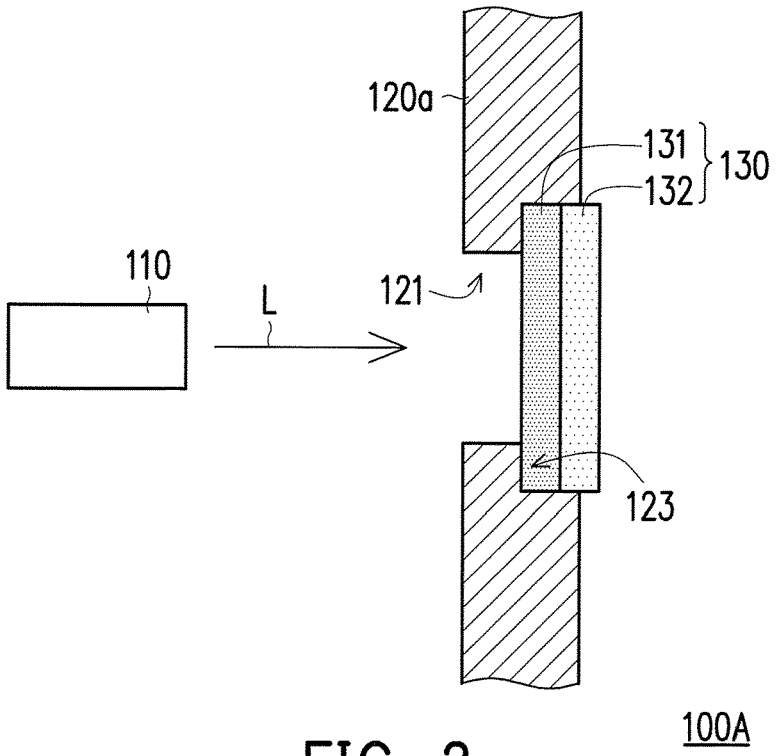
FIG. 2 is a schematic diagram of a light-emitting module according to another embodiment of the invention.

FIG. 2 is a schematic diagram of a light-emitting module according to another embodiment of the invention. Referring to FIG. 2, the light-emitting module 100A is similar to the light-emitting module 100, and a main difference therebetween is that the light-converting component 130 can be connected to the heat dissipation element 120*a* respectively through the first light-converting layer 131 and the second light-converting layer 132, i.e., the first light-converting layer 131 and the second light-converting layer 132 are all located in the accommodating groove 123. The depth of the accommodating groove 123 is substantially greater than the thickness of the first light-converting layer 131, but is smaller than a sum of the thickness of the first light-converting layer 131 and the thickness of the second light-converting layer 132, so that only a part of the second light-converting layer 132 is exposed outside the heat dissipation element 120*a*. On the other hand, since the second light-converting layer 132 also contacts the heat dissipation element 120*a*, the heat generated during the light conversion thereof is not only transferred to the heat dissipation element 120*a* through the first light-converting layer 131, but is also directly transferred to the heat dissipation element 120*a* based on the connection relationship between the second light-converting layer 132 and the heat dissipation element 120*a*.

Figure 3:
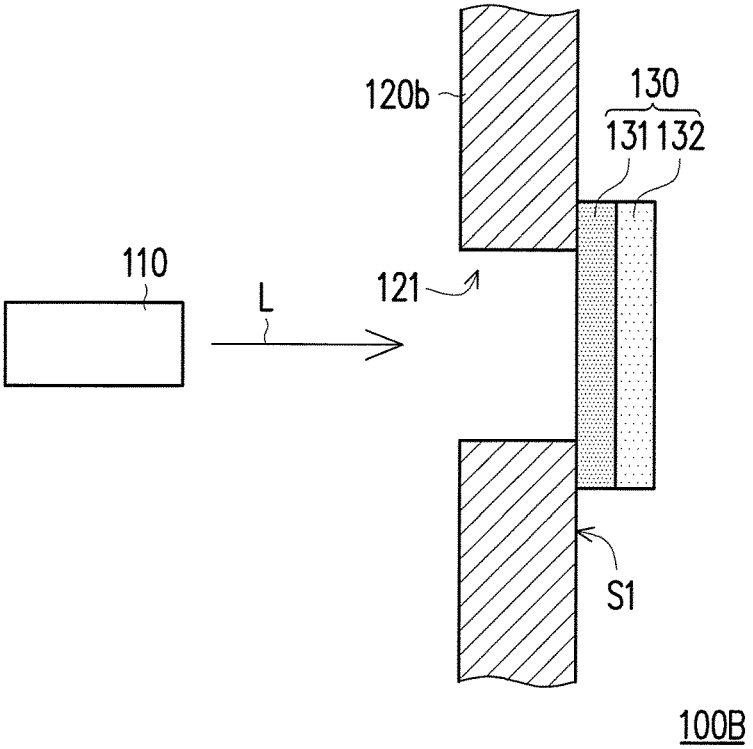
FIG. 3 is a schematic diagram of a light-emitting module according to another embodiment of the invention.

FIG. 3 is a schematic diagram of a light-emitting module according to another embodiment of the invention. Referring to FIG. 3, the light-emitting module 100B is similar to the light-emitting module 100, and a main difference therebetween is that the heat dissipation element 120*b* does not has the accommodating groove, and the light-converging component 130 is, for example, connected to the surface S1 of the heat dissipation element 120*b* through the first light converting layer 130. Now, the second light-converting layer 132 does not contact the heat dissipation element 120*b*.

Figure 4:
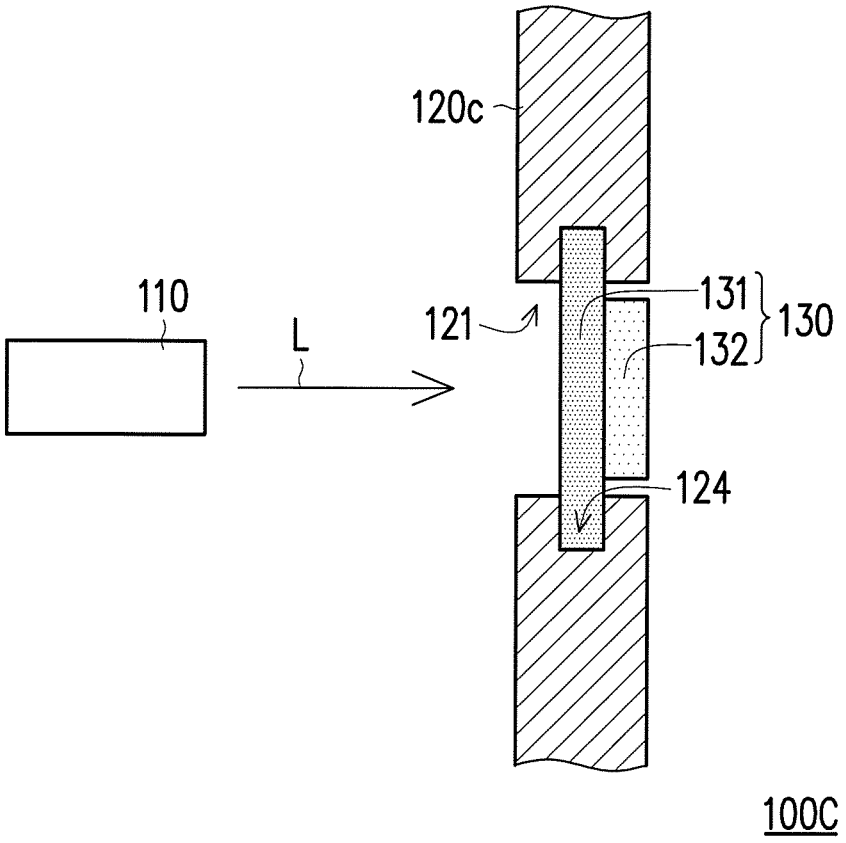
FIG. 4 is a schematic diagram of a light-emitting module according to another embodiment of the invention.

FIG. 4 is a schematic diagram of a light-emitting module according to another embodiment of the invention. Referring to FIG. 4, the light-emitting module 100C is similar to the light-emitting module 100, and a main difference therebetween is that the accommodating groove 124 of the heat dissipation element 120*c* is located in the light through hole 121. For example, the heat dissipation element 120*c* can be composed of two sub-boards, and the light-converting element 130 is, for example, clamped by the two sub-boards for being fixed in the accommodating groove 124. In the present embodiment, a situation that the first light-converting layer 131 is clamped by the two sub-boards is taken as an example for description, though the invention is not limited thereto. Namely, in other embodiments, the first light-converting layer 131 and the second light-converting layer 132 can be simultaneously clamped by the two sub-boards, such that the first light-converting layer 131 and the second light-converting layer 132 are all connected to the heat dissipation element 120*c* through the accommodating groove 124.

It should be noted that the light emitting device 10 can also adopt the design concept of the light-emitting modules 100A to 100C of the aforementioned embodiments, and is not limited to the design concept of the light-emitting module 100, detailed implementations thereof can be deduced according to the aforementioned descriptions, and details thereof are not repeated.

In summary, the light-converting component of the invention may include two layers of light-converting layers, in which at least one layer of the light-converting layer is connected to the heat dissipation element. Therefore, the heat generated by the light-converting component as the light-converting component receives the light generated by the light-emitting component to perform light conversion can be transmitted to the heat dissipation element, and the heat is dissipated through thermal exchange between the heat dissipation element and external air. In this way, the heat is not accumulated on the light-converting component, such that the light-converting component has higher light-converting efficiency, and the light-emitting module has higher light-emitting efficiency.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A light-emitting module, comprising:

a light-emitting component, adapted to emit a light beam;

a heat dissipation element, having a light through hole and an accommodating groove, wherein the heat dissipation element is disposed at one side of the light-emitting component, and the light through hole is located at a transmission path of the light beam; and a light-converting component, connected to the heat dissipation element through the accommodating groove and covering a side of the light through hole where the light beam leaving, the light-converting component comprises a first light-converting layer and a second light-converting layer, wherein the first light-converting layer is disposed between the heat dissipation element and the second light-converting layer, and a contact area between the first light-converting layer and the heat dissipation element is larger than a contact area between the second light-converting layer and the heat dissipation element, wherein a depth of the accommodating groove is smaller than a sum of a thickness of the first light-converting layer and a thickness of the second light-converting layer, and the depth of the accommodating groove is greater than the thickness of the first light-converting layer.

2. The light-emitting module as claimed in claim 1, wherein the accommodating groove is located on a surface of the heat dissipation element.

3. The light-emitting module as claimed in claim 1, wherein the accommodating groove is located inside the light through hole and the heat dissipation element.

4. The light-emitting module as claimed in claim 1, wherein the first light-converting layer is connected to the heat dissipation element.

5. The light-emitting module as claimed in claim 4, wherein the heat dissipation element comprises two sub-boards and the light-converting component is clamped by the two sub-boards.

6. The light-emitting module as claimed in claim 5, wherein the first light-converting layer is clamped by the two sub-boards of the heat dissipation element and the second light-converting layer separates from two sub-boards of the heat dissipation element.

7. The light-emitting module as claimed in claim 1, wherein the first light-converting layer and the second light-converting layer are all connected to the heat dissipation element.

8. The light-emitting module as claimed in claim 1, wherein heat transfer coefficient of the first light-converting layer is higher than heat transfer coefficient of the second light-converting layer.

9. The light-emitting module as claimed in claim 1, wherein a material of the first light-converting layer and the second light-converting layer are respectively selected from single crystal phosphor, polycrystalline phosphor, glass phosphor and fluorescent gel.

10. The light-emitting module as claimed in claim 1, wherein materials of the first light-converting layer and the second light-converting layer are different.

11. A light-emitting module, comprising:

a light-emitting component, adapted to emit a light beam;

a heat dissipation element, disposed at one side of the light-emitting component, wherein the heat dissipation element has a plurality light through holes, and the light through holes are located at a transmission path of the light beam;

a plurality light-converting components, connected to the heat dissipation element, and covering a side of each of the corresponding light through holes where the light leaving; and a plurality of beam splitters, each of the beam splitters is disposed above the corresponding light-converting component and located on the transmission path of the light beam emitted by the light-emitting component, wherein the light beam irradiates the corresponding light-converting component through the beam splitter.

12. A light-emitting module, comprising:

a light-emitting component, adapted to emit a light beam;

a heat dissipation element, having a light through hole and an accommodating groove, wherein the heat dissipation element is disposed at one side of the light-emitting component, and the light through hole is located at a transmission path of the light beam; and a light-converting component, connected to the heat dissipation element through the accommodating groove and covering a side of the light through hole where the light beam leaving, the light-converting component comprises a first light-converting layer and a second light-converting layer, wherein the first light-converting layer is disposed between the heat dissipation element and the second light-converting layer, a contact area between the first light-converting layer and the heat dissipation element is larger than a contact area between the second light-converting layer and the heat dissipation element, a depth of the accommodating groove is smaller than a thickness of the first light-converting layer, and the accommodating groove exposes a portion of the first light-converting layer and the second light-converting layer.

* * * * *